US007282013B2

(12) United States Patent
Ho

(10) Patent No.: US 7,282,013 B2
(45) Date of Patent: Oct. 16, 2007

(54) EXERCISER WITH TWO ROTATING AXLES

(76) Inventor: Shou-Shan Ho, No. 101, Chung-Tsun Rd., Lung-Chin Village, Lung-Ching Hsiang, Taichung Hsien (TW)

( * ) Notice: Subject to any disclaimer, the term of this patent is extended or adjusted under 35 U.S.C. 154(b) by 99 days.

(21) Appl. No.: 11/326,317

(22) Filed: Jan. 6, 2006

(65) Prior Publication Data

US 2007/0161462 A1 Jul. 12, 2007

(51) Int. Cl.
*A63B 22/00* (2006.01)
*A63B 69/18* (2006.01)
*A63F 13/00* (2006.01)

(52) U.S. Cl. ..... 482/51; 482/71; 463/36

(58) Field of Classification Search ..... 482/51–52, 482/71; 472/95–97; 434/247, 253, 66; 463/36
See application file for complete search history.

(56) References Cited

U.S. PATENT DOCUMENTS 4,478,407 A * 10/1984 Manabe ..... 472/60
4,749,180 A * 6/1988 Boomer ..... 482/51
4,838,540 A * 6/1989 Ouellet ..... 482/51
4,850,588 A * 7/1989 Desjardins et al. ..... 482/51
4,978,299 A * 12/1990 Denne ..... 434/58
5,009,412 A * 4/1991 Roodenburg et al. ..... 472/59
5,409,226 A * 4/1995 Mesko et al. ..... 273/148 B
5,429,562 A * 7/1995 Milner ..... 482/51
5,509,871 A * 4/1996 Giovanni ..... 482/51
5,904,636 A * 5/1999 Chen ..... 482/51
6,139,473 A * 10/2000 Koyama et al. ..... 482/8
6,739,974 B2 * 5/2004 Kanno et al. ..... 463/36
6,955,634 B1 * 10/2005 Lat ..... 482/71

* cited by examiner

*Primary Examiner*—Stephen R. Crow
(74) *Attorney, Agent, or Firm*—Bacon & Thomas, PLLC

(57) ABSTRACT

An exerciser has a base, a driving device, a supporting board and a control device. The driving device is mounted on the base and has a motor, two rotating axles, two shaking arms, two swinging shafts and two lateral arms. The motor is securely attached to the base. The rotating axles are rotatably mounted on the base and have an angle between the rotating axles to make the rotating axles to form a V-shaped arrangement on the base. The shaking arms are securely and respectively attached to the rotating axles. The swinging shafts are rotatably and respectively attached to the shaking arms. The lateral arms including a first lateral arm and a second lateral arm are respectively mounted on the swinging shafts. The supporting board is pivotally connected to the first lateral arm and is slidably connected to the second lateral arm.

18 Claims, 9 Drawing Sheets

EXERCISER WITH TWO ROTATING AXLES

BACKGROUND OF THE INVENTION

1. Field of the Invention

The present invention relates to an exerciser, and more particularly to an exerciser with two rotating axles for realistic simulation of wave surfing and having a simplified structure.

2. Description of Related Art

Indoor exercisers are widely used due to convenience of using these exercisers. A conventional indoor exerciser, such as a treadmill or a stepping exerciser, substantially comprises a transmission device composed of mechanical elements or levers to realistic simulate sport. However, the conventional indoor exerciser has a complex structure and takes a large space for using, storing or transporting, so the conventional indoor exerciser is not convenient in manufacturing and use.

To overcome the shortcomings, the present invention tends to provide an exerciser to mitigate or obviate the aforementioned problems.

SUMMARY OF THE INVENTION

The main objective of the invention is to provide an exerciser for realistic simulation of wave surfing and having a simplified structure. The exerciser has a base, a driving device, a supporting board and a control device.

The driving device is mounted on the base and has a motor, two rotating axles, two shaking arms, two swinging shafts and two lateral arms. The motor is securely attached to the base and has a driving spindle. The rotating axles are rotatably mounted on the base, are driven by the motor and have an angle between the rotating axles to make the rotating axles to form a V-shaped arrangement on the base. The shaking arms are securely and respectively attached to and extend from the rotating axles. The swinging shafts are rotatably and respectively attached to the shaking arms. The lateral arms including a first lateral arm and a second lateral arm are respectively mounted on and laterally extend from the swinging shafts. The supporting board is pivotally connected to the first lateral arm and is slidably connected to the second lateral arm. The control device is electrically connected to the driving device.

Other objects, advantages and novel features of the invention will become more apparent from the following detailed description when taken in conjunction with the accompanying drawings.

DETAILED DESCRIPTION OF PREFERRED EMBODIMENT

Figure 1:
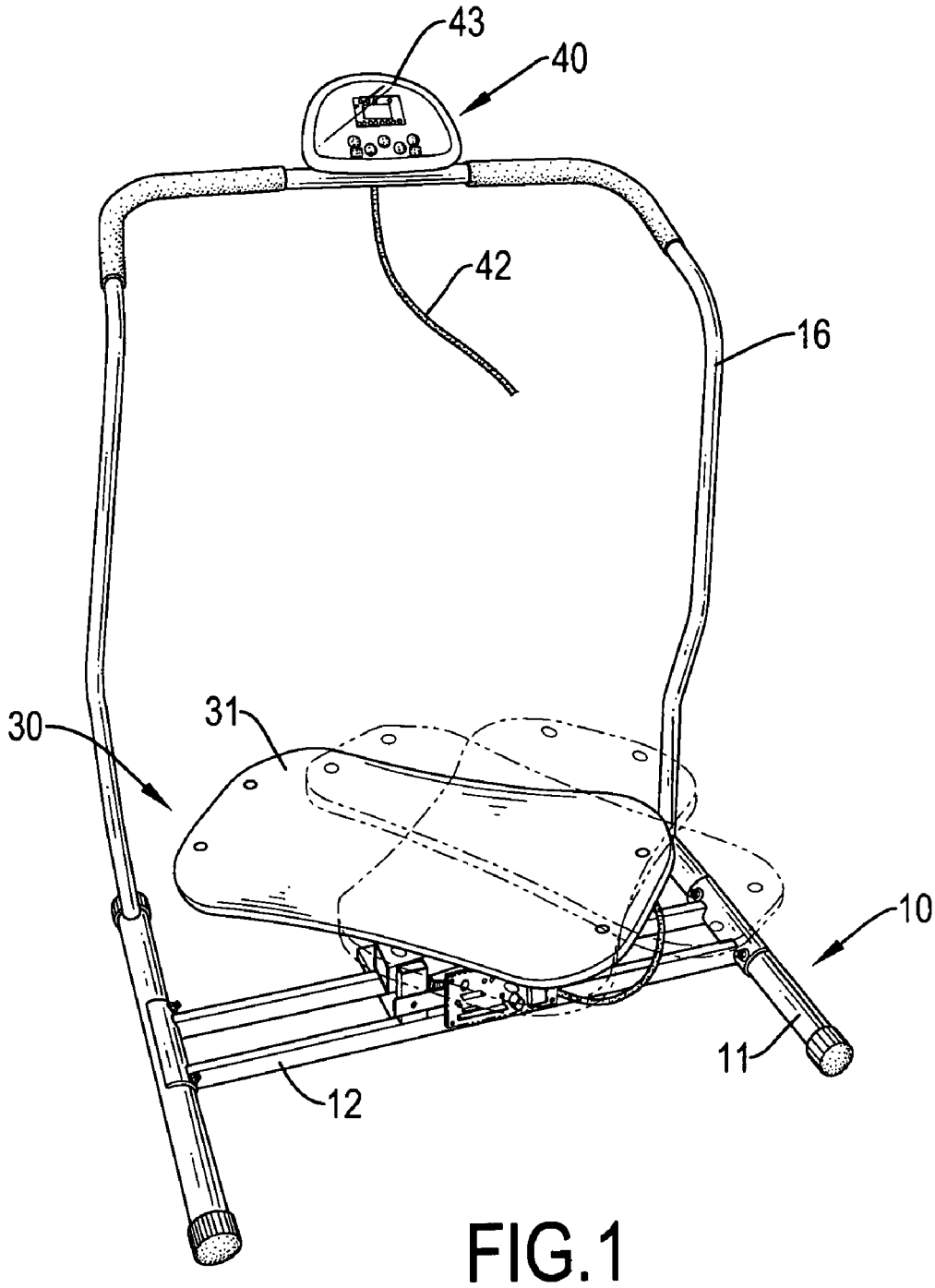
FIG. 1 is an operational perspective view of an exerciser in accordance with the present invention.
Figure 2:
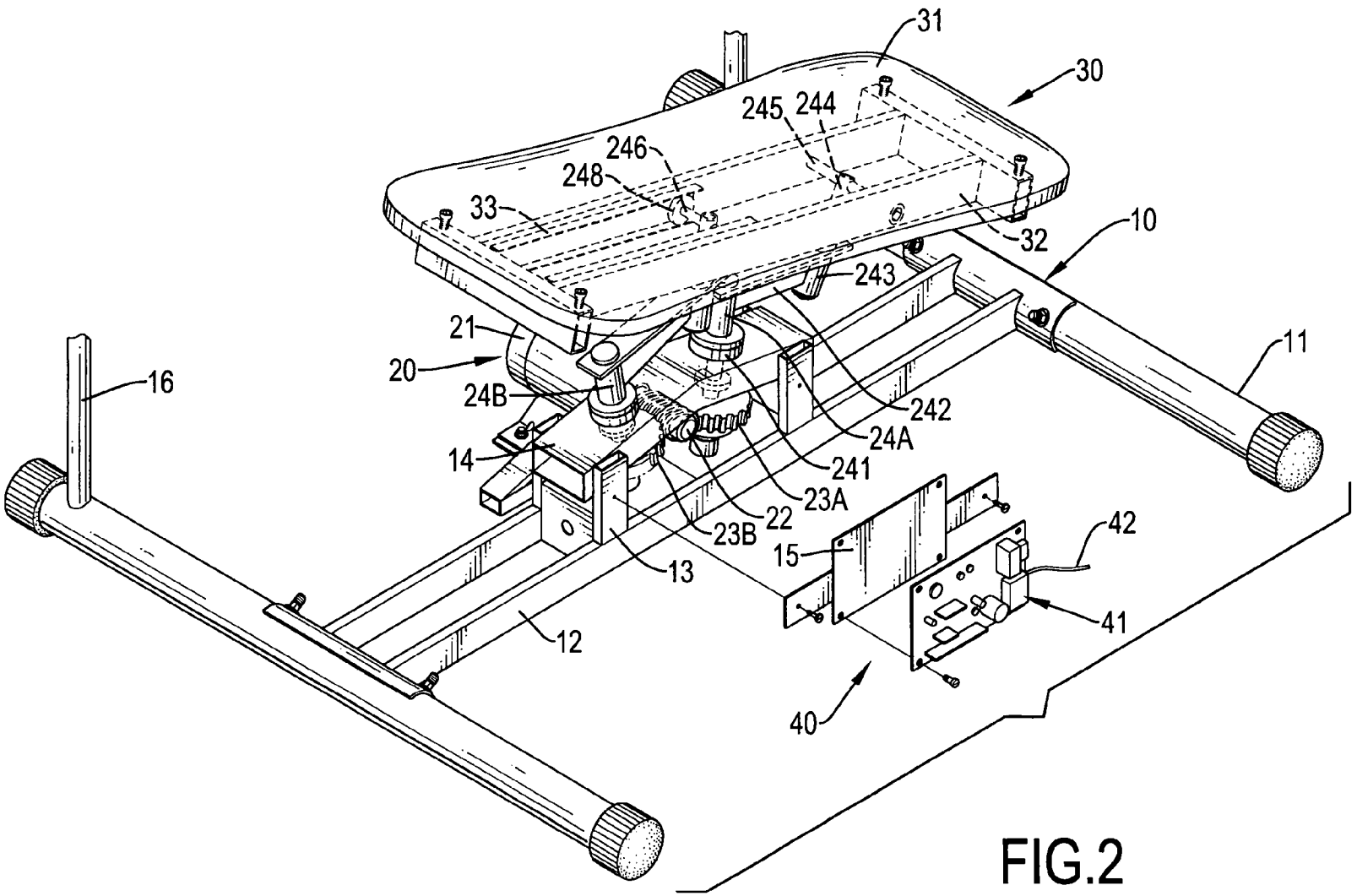
FIG. 2 is an exploded perspective view of the base and the control device of the exerciser in FIG. 1.
Figure 3:
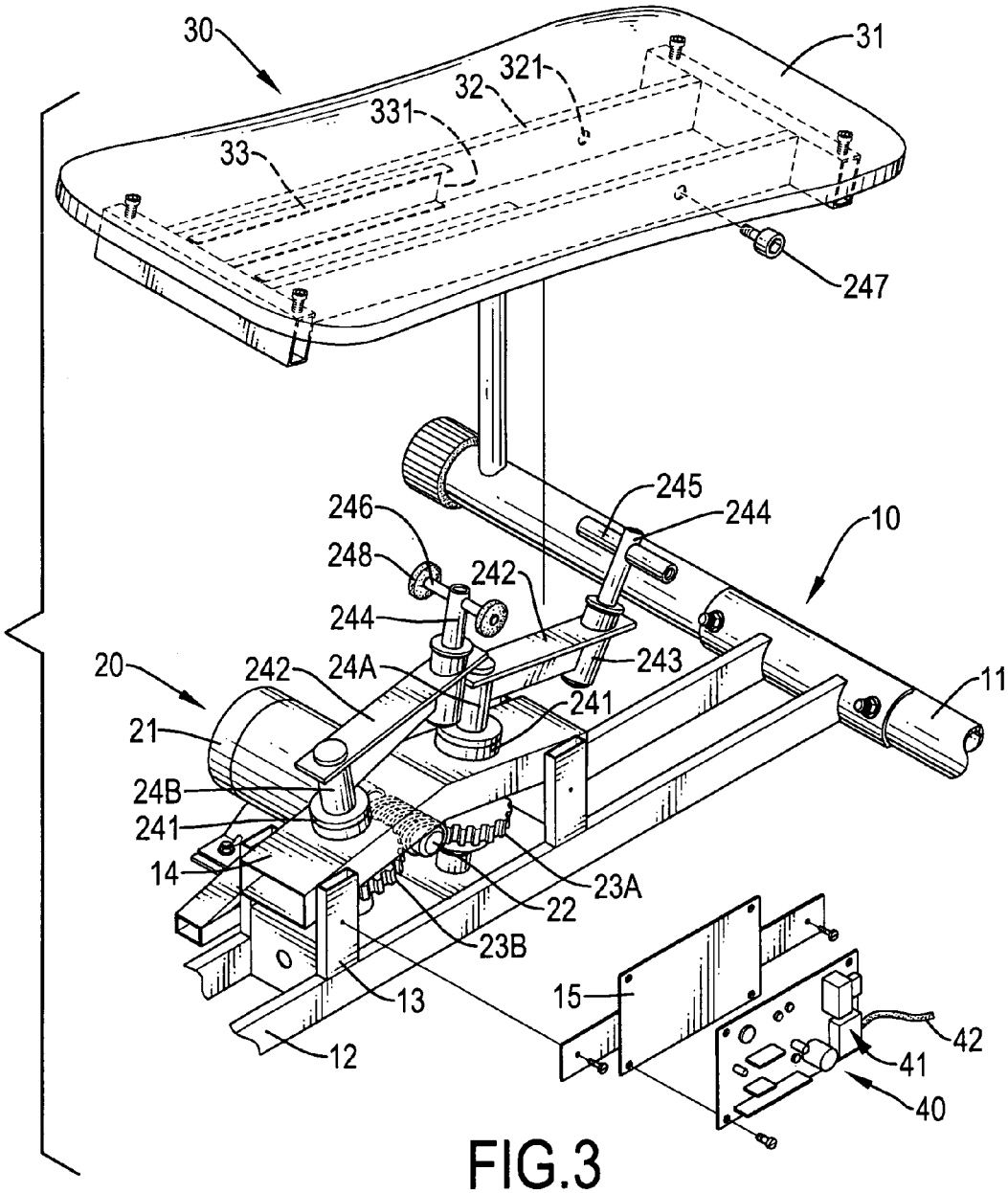
FIG. 3 is an exploded perspective view of the base, the supporting board and the control device of the exerciser in FIG. 1.
Figure 4:
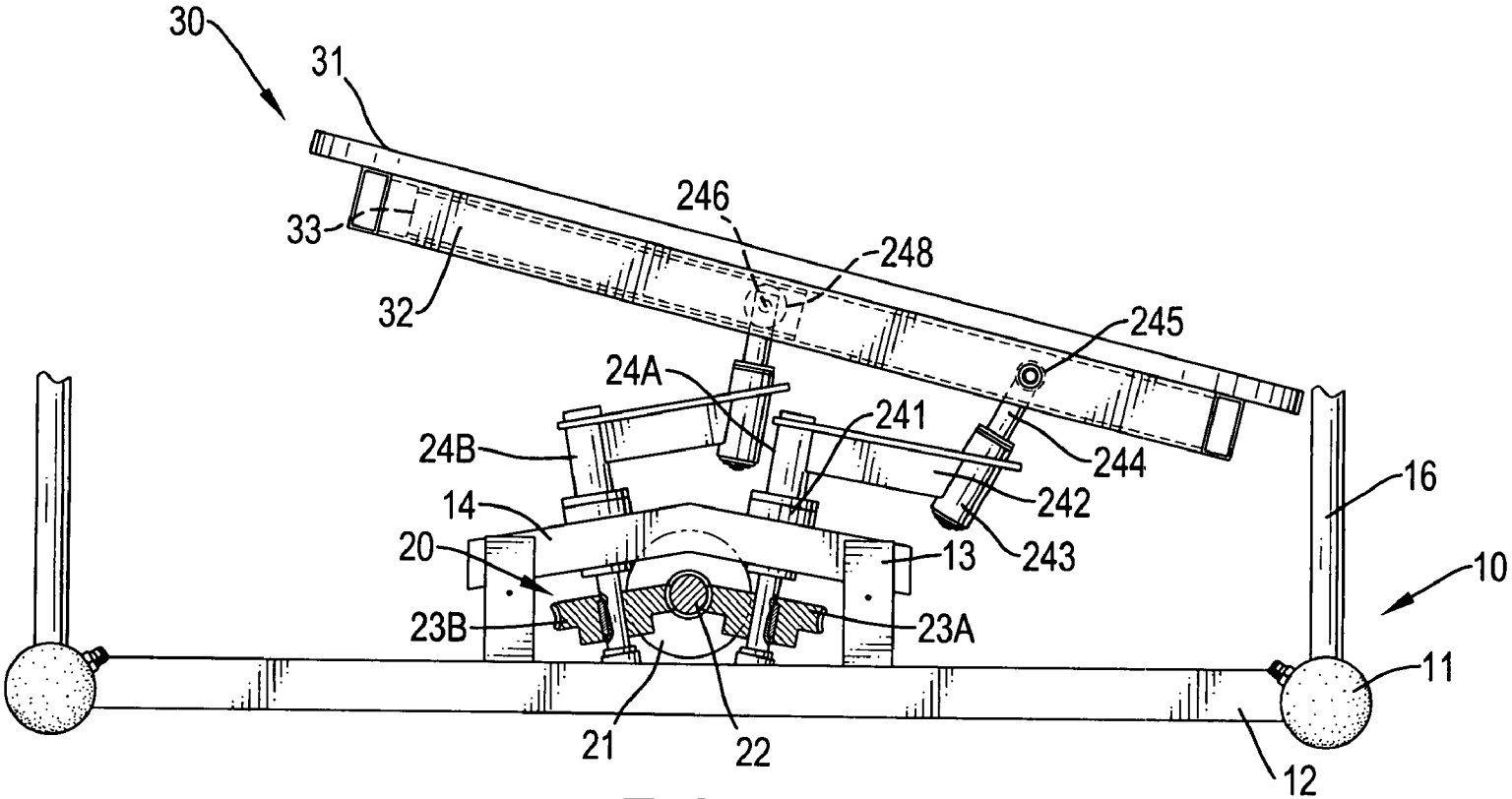
FIG. 4 is a side plan view in partial cross section of the exerciser in FIG. 1.
Figure 5:
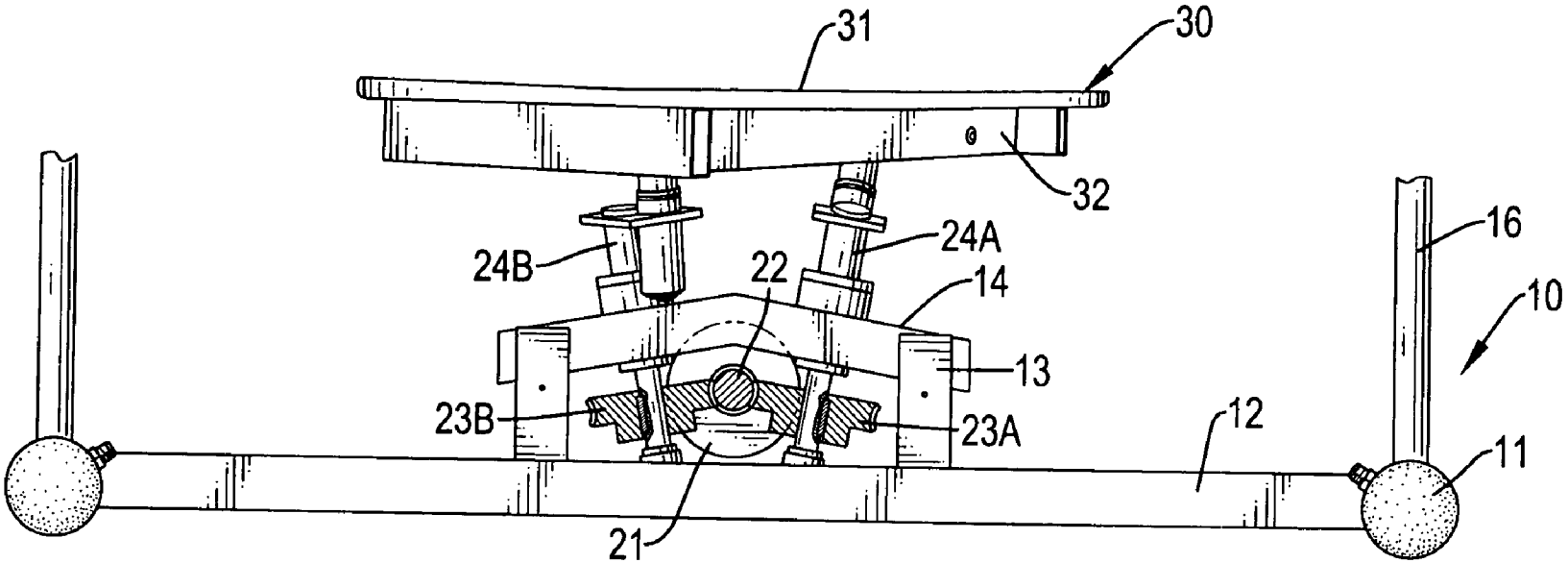
FIG. 5 is an operational side plan view in partial cross section of the exerciser in FIG. 4.
Figure 6:
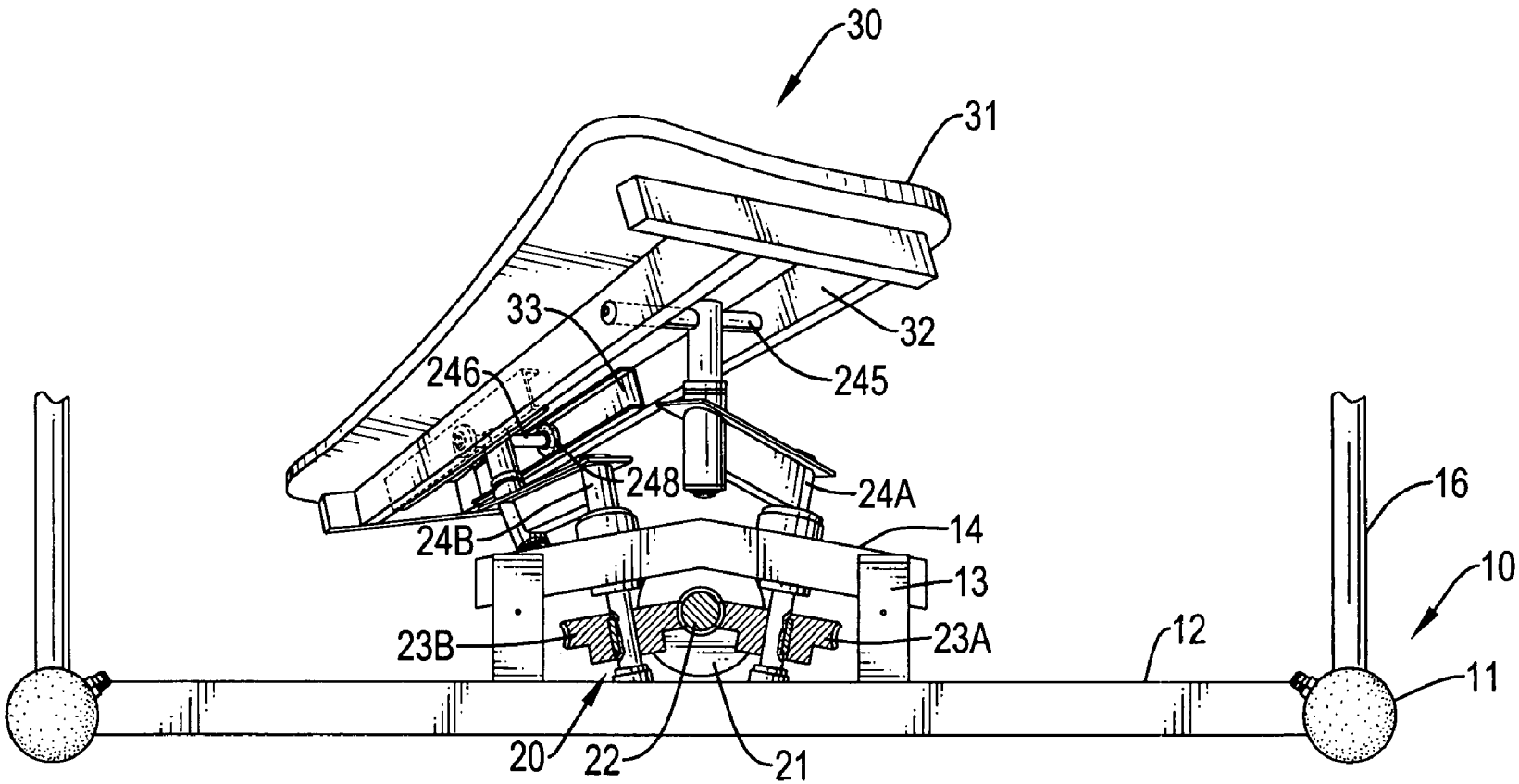
FIG. 6 is an operational side plan view in partial cross section of the exerciser in FIG. 4.
Figure 7:
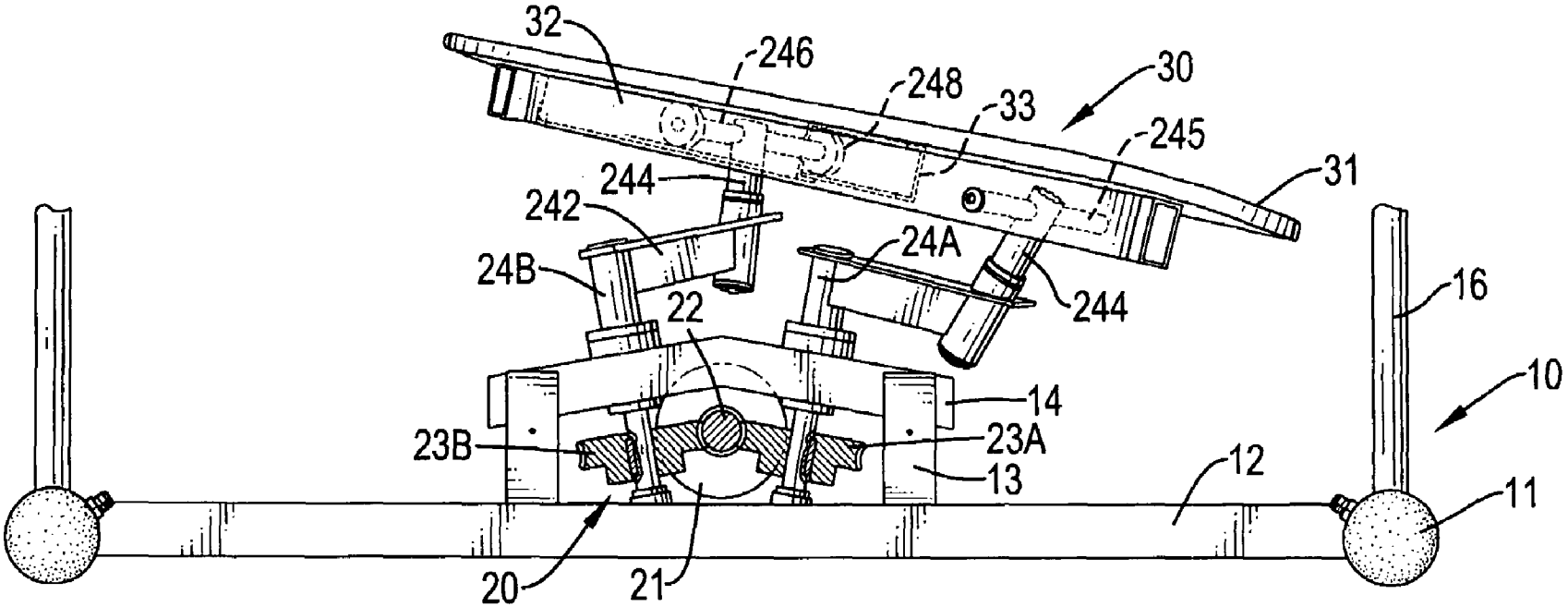
FIG. 7 is an operational side plan view in partial cross section of the exerciser in FIG. 4.

With reference to FIGS. 1 to 4, an exerciser in accordance with the present invention comprises a base (10), a driving device (20), a supporting board (30) and a control device (40).

The base (10) comprises a central frame (12), two lateral legs (11), two posts (13), an axle mount (14) and a handle (16). The central frame (12) has two ends. The lateral legs (11) are attached respectively to the ends of the central frame (12). The posts (13) are mounted on and extend upward from the central frame (12). The axle mount (14) is mounted between the posts (13), is inverse V-shaped and has two inclined wings. The handle (16) is attached between and extends upward from the lateral legs (11) to allow a user to grip the handle (16).

The driving device (20) is mounted on the base (10) and has a motor (21), two rotating axles (24A,24B), two shaking arms (242), two swinging shafts (244) and two lateral arms (245,246). The motor (21) is securely attached to the base (10) and has a driving spindle. The rotating axles (24A,24B) are rotatably and respectively mounted on and extend through the inclined wings of the axle mount (14) with bearings (241). The rotating axles (24A,24B) are driven by the motor (21) with a transmission device and have an angle between the rotating axles (24A,24B) to make the rotating axles (24A,24B) to form a V-shaped arrangement on the base (10). In a preferred embodiment, the transmission device comprises a worm shaft (22) and two worm wheels (23A,23B). The worm shaft (22) is coaxially mounted on the driving spindle of the motor (21). The worm wheels (23A, 23B) are attached respectively to the rotating axles (24A, 24B) with keys and engage with the worm shaft (22), such that the rotating axles (24A,24B) will be driven by the rotating spindle to rotate with the worm wheels (23A,23B) by the transmission of the worm shaft (22). In addition, the bottoms of the rotating axles (24A,24B) abut with the central frame (12) of the base (10).

The shaking arms (242) are securely and respectively attached to and extend from the rotating axles (24A,24B). Each shaking arm (242) is securely attached to and extends from a corresponding rotating axle (24A,24B) at a perpendicular angle. Each shaking arm (242) has a sleeve (243) securely attached to one end of the shaking arm (242) at an angle relative to a corresponding rotating axle (24A,24B).

The swinging shafts (244) are rotatably and respectively mounted in the sleeves (243) on the shaking arms (242).

The lateral arms (245,246) including a first lateral arm (245) and a second lateral arm (246) are respectively mounted on and laterally extend from the swinging shafts (244). The second lateral arm (246) has two rollers (248) mounted respectively on two ends of the second lateral arm (246).

The supporting board (30) is pivotally connected to the first lateral arm (245) and is slidably connected to the second lateral arm (246) to support a user. The supporting board (30) has a body (31) with a bottom, two rods (32) and two rails (33). The rods (32) are securely mounted on the bottom of the body (31) and are parallel to each other. Each rod (32) has a pivotal hole (321) defined through the rod (32) and aligning with each other and an inner side facing to each other. The first lateral arm (245) has two ends aligning respectively with the pivotal holes (321) in the rods (32), and two pivots (247) extend respectively through the pivotal holes (321) and are screwed respectively into two ends of the first lateral arm (245) to pivotally connect the first lateral arm (245) to the supporting board (30). The rails (33) are securely attached respectively to the inner sides of the rods (32) and each have a channel (331), and the rollers (248) on the second lateral arm (246) are rotatably attached to the rails (33) and held inside the channels (331), respectively.

The control device (40) is electrically connected to the driving device (20) and comprises a mounting plate (15), a circuit board (41) and a control meter (43). The mounting plate (15) is mounted between the posts (13). The circuit board (41) is attached to the mounting plate (15), is electrically connected to the motor (21) with wires (42) and has a circuit and multiple electric components mounted on the circuit board (41). The control meter (43) is attached to the handle (16) and is electrically connected to the circuit board (41). Accordingly, the user can control the rotation speed of motor (21), operation period of the exerciser or to switch on or off the exerciser through the control meter (43) on the handle (16).

In such an arrangement, with reference to FIGS. 1 and 4 to 7, when the motor (21) is switched on, the rotating axles (24A,24B) will be rotated with the transmission of the rotating spindle, the worm shaft (22) and the worm wheels (23A,23B). The shaking arms (242) will be rotated with the rotating axles (24A,24B). With the pivotal connection and slidable connection between the supporting board (30) and the lateral arms (245,246) and the V-shaped arrangement of the rotating axles (24A,24B), the supporting board (30) can be swung, rotated, lifted and inclined at various angles with the transmission of the swinging shafts (244) and the lateral arms (245,246). Accordingly, the exerciser can provide a realistic simulation for wave surfing, so that a training effect to muscles of hands, legs, waist of the user is provided. In addition, to stand on the swinging supporting board (30) in stable, a balancing training effect is also provided. With such an exerciser, the structure of the exerciser is simplified, and the cost for manufacturing the exerciser is lowered. In addition, the exerciser takes a small space for storing and using, to use or to transport the exerciser is convenient.

Figure 8:
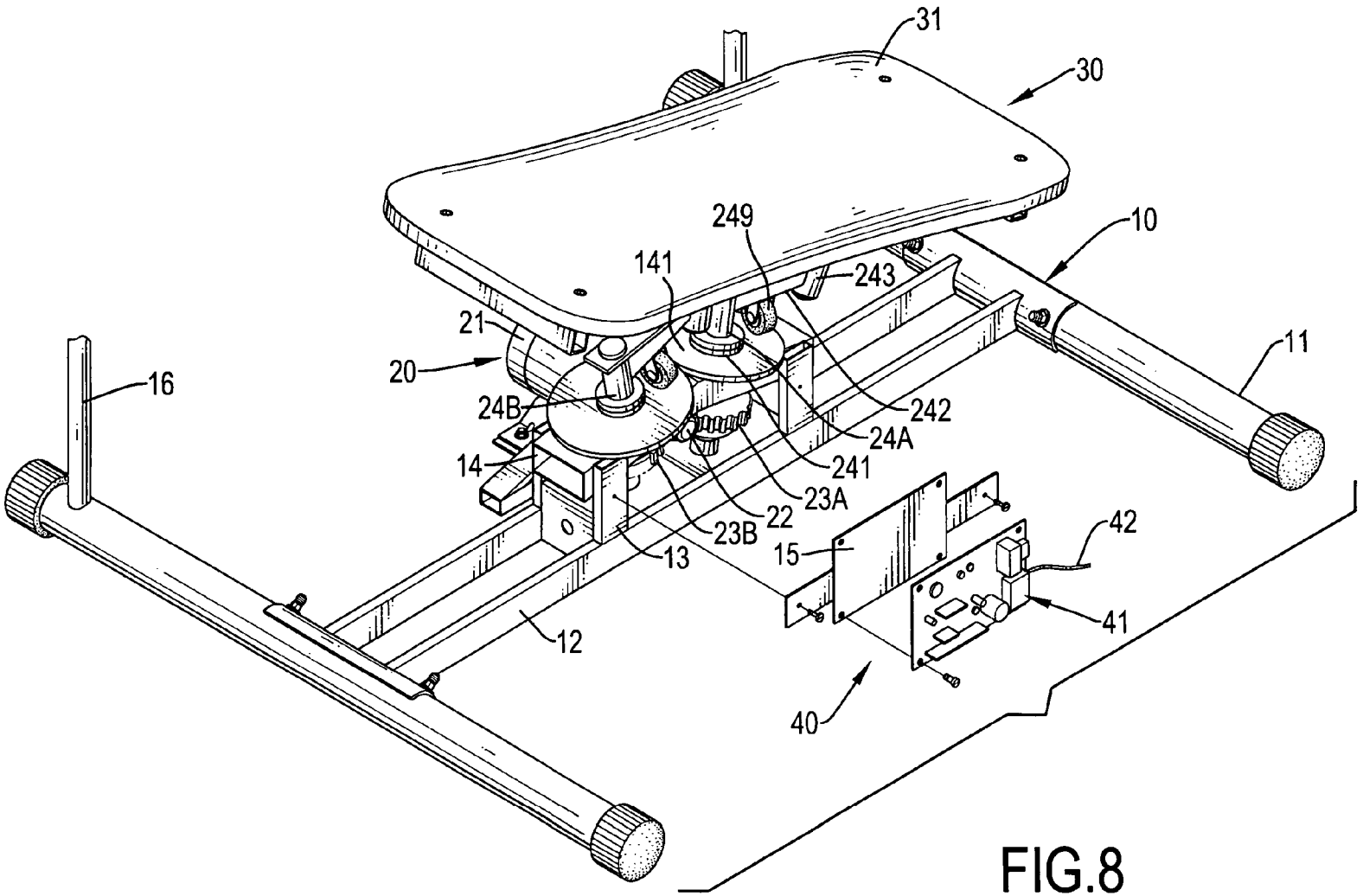
FIG. 8 is an exploded perspective view of another embodiment of an exerciser in accordance with the present invention.
Figure 9:
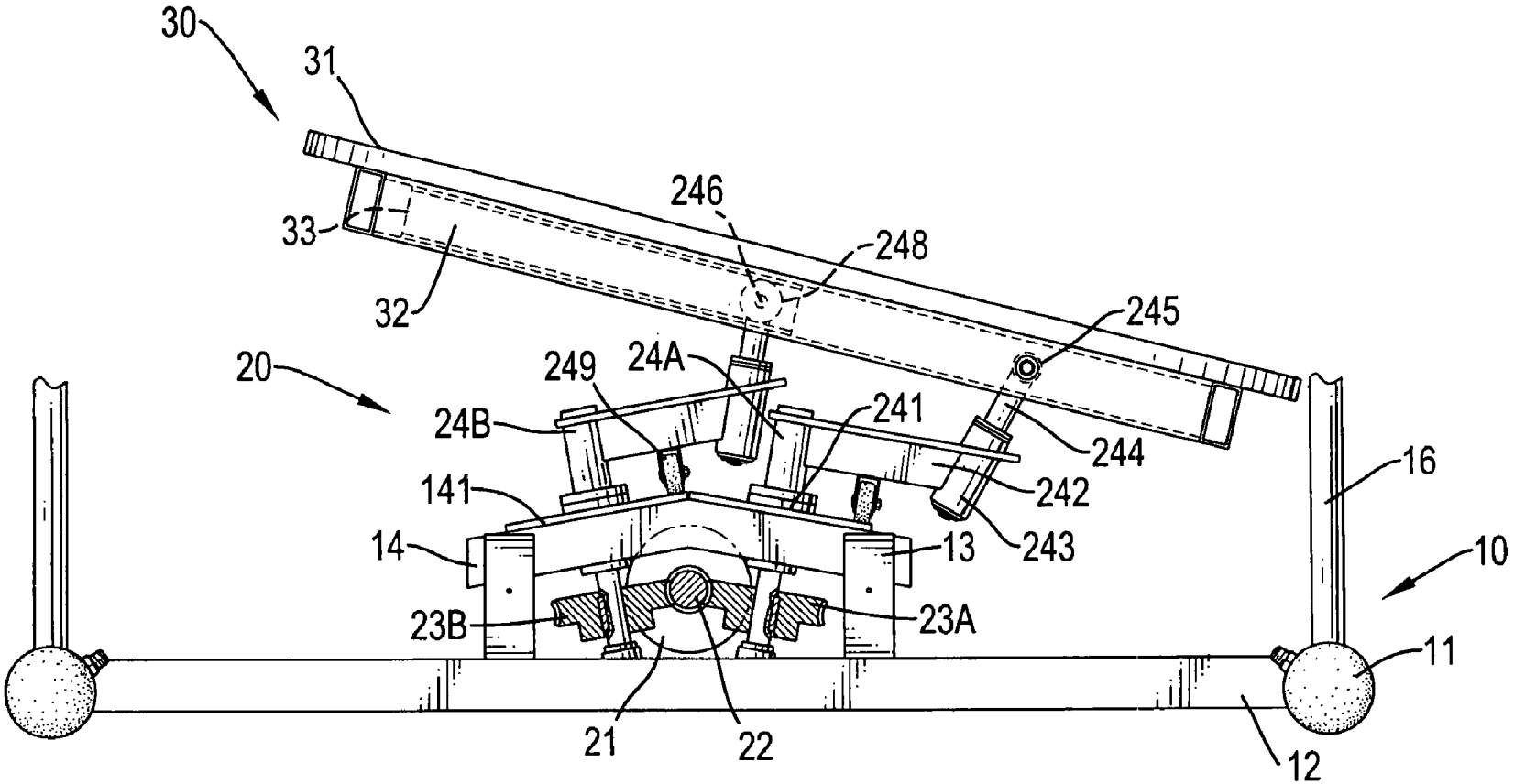
FIG. 9 is a side plan view in partial cross section of the exerciser in FIG. 8.

With reference to FIGS. 8 and 9, in a second embodiment, the axle mount (14) further has two supporting plates (141) mounted respectively to the inclined wings and respectively around the bearings (241). Each shaking arm (242) has a bottom provided with a supporting wheel (249) abutting with a corresponding supporting plate (141) on the axle mount (14). With the abutment between the supporting wheels (249) and the supporting plates (141), an auxiliary supporting effect is provided to the shaking arms (242) to reduce shearing stress applied to the rotating axles (24A, 24B) and the shaking arms (242). Accordingly, deformation of the rotating axles (24A,24B) is prevented.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An exerciser comprising:

a base;

a driving device mounted on the base and having a motor securely attached to the base and having a driving spindle;

two rotating axles rotatably mounted on the base, driven by the motor and having an angle between the rotating axles to make the rotating axles to form a V-shaped arrangement on the base;

two shaking arms securely and respectively attached to and extending from the rotating axles;

two swinging shafts rotatably and respectively attached to the shaking arms; and two lateral arms including a first lateral arm and a second lateral arm respectively mounted on and laterally extending from the swinging shafts;

a supporting boar pivotally connected to the first lateral arm and slidably connected to the second lateral arm; and a control device electrically connected to the driving device.

2. The exerciser as claimed in claim 1, wherein the driving device further comprises a worm shaft coaxially mounted on the driving spindle of the motor; and two worm wheels attached respectively to the rotating axles and engaging with the worm shaft.

3. The exerciser as claimed in claim 2, wherein the base has an inverse V-shaped axle mount having two inclined wings; and each rotating axle is rotatably mounted on and extend through one of the inclined wings of the axle mount with a bearing.

4. The exerciser as claimed in claim 3, wherein each shaking arm is securely attached to and extends from a corresponding one of the rotating axles at a perpendicular angle;

each shaking arm has a sleeve securely attached to one end of the shaking arm at an angle relative to a corresponding rotating axle; and the swinging shafts are rotatably and respectively mounted in the sleeves.

5. The exerciser as claimed in claim 3, wherein the axle mount further has two supporting plates mounted respectively to the inclined wings and respectively around the bearings; and each shaking arm has a bottom provided with a supporting wheel abutting with a corresponding supporting plate on the axle mount.

6. The exerciser as claimed in claim 5, wherein each shaking arm is securely attached to and extends from a corresponding one of the rotating axles at a perpendicular angle;

each shaking arm has a sleeve securely attached to one end of the shaking arm at an angle relative to a corresponding rotating axle; and the swinging shafts are rotatably and respectively mounted in the sleeves.

7. The exerciser as claimed in claim 6, wherein the supporting board comprises a body having a bottom;

two rods securely mounted on the bottom of the body and parallel to each other and each having an inner side facing to each other;

two rails securely attached respectively to the inner sides of the rods; and the second lateral arm has two rollers mounted respectively on two ends of the second lateral arm and rotatably attached to the rails, respectively.

8. The exerciser as claimed in claim 7, wherein the base comprises a central frame having two ends;

two lateral legs attached respectively to the ends of the central frame; and two posts mounted on and extending upward from the central frame; and the axle mount is mounted between the posts.

9. The exerciser as claimed in claim 8 further comprising a handle attached between the lateral legs.

10. The exerciser as claimed in claim 9, wherein the control device comprises a mounting plate mounted between the posts;

a circuit board attached to the mounting plate and electrically connected to the motor with wires; and a control meter attached to the handle and electrically connected to the circuit board.

11. The exerciser as claimed in claim 1, wherein the base has an inverse V-shaped axle mount having two inclined wings; and each rotating axle is rotatably mounted on and extend through one of the inclined wings of the axle mount with a bearing.

12. The exerciser as claimed in claim 11, wherein the axle mount further has two supporting plates mounted respectively to the inclined wings and respectively around the bearings; and each shaking arm has a bottom provided with a supporting wheel abutting with a corresponding supporting plate on the axle mount.

13. The exerciser as claimed in claim 12, wherein each shaking arm is securely attached to and extends from a corresponding one of the rotating axles at a perpendicular angle;

each shaking arm has a sleeve securely attached to one end of the shaking arm at an angle relative to a corresponding rotating axle; and the swinging shafts are rotatably and respectively mounted in the sleeves.

14. The exerciser as claimed in claim 13, wherein the base comprises a central frame having two ends;

two lateral legs attached respectively to the ends of the central frame; and two posts mounted on and extending upward from the central frame; and the axle mount is mounted between the posts.

15. The exerciser as claimed in claim 14 further comprising a handle attached between the lateral legs.

16. The exerciser as claimed in claim 15, wherein the control device comprises a mounting plate mounted between the posts;

a circuit board attached to the mounting plate and electrically connected to the motor with wires; and a control meter attached to the handle and electrically connected to the circuit board.

17. The exerciser as claimed in claim 1, wherein each shaking arm is securely attached to and extends from a corresponding one of the rotating axles at a perpendicular angle;

each shaking arm has a sleeve securely attached to one end of the shaking arm at an angle relative to a corresponding rotating axle; and the swinging shafts are rotatably and respectively mounted in the sleeves.

18. The exerciser as claimed in claim 1, wherein the supporting board comprises a body having a bottom;

two rods securely mounted on the bottom and parallel to each other and each having an inner side facing to each other;

two rails securely attached respectively to the inner sides of the rods; and the second lateral arm has two rollers mounted respectively on two ends of the second lateral arm and rotatably attached to the rails, respectively.

* * * * *